US007884716B2

(12) United States Patent
Ishida

(10) Patent No.: US 7,884,716 B2
(45) Date of Patent: Feb. 8, 2011

(54) MOVIE PROJECTION SYSTEM

(75) Inventor: Tessho Ishida, Kanagawa (JP)

(73) Assignee: Sony Corporation, Tokyo (JP)

( * ) Notice: Subject to any disclaimer, the term of this patent is extended or adjusted under 35 U.S.C. 154(b) by 359 days.

(21) Appl. No.: 12/099,845

(22) Filed: Apr. 9, 2008

(65) Prior Publication Data

US 2008/0272912 A1 Nov. 6, 2008

(30) Foreign Application Priority Data

May 1, 2007 (JP) ..... 2007-120953

(51) Int. Cl.
*G08B 13/08* (2006.01)

(52) U.S. Cl. ..... 340/545.6

(58) Field of Classification Search ..... 340/545.6, 340/506, 545.1, 541; 353/74
See application file for complete search history.

(56) References Cited

U.S. PATENT DOCUMENTS 6,018,374 A * 1/2000 Wrobleski ..... 348/744
6,950,532 B1 * 9/2005 Schumann et al. ..... 382/100
7,036,021 B2 * 4/2006 Koguchi et al. ..... 713/194
7,428,757 B2 * 9/2008 Sitrick et al. ..... 726/28
2004/0062393 A1 * 4/2004 Sitrick et al. ..... 380/201

FOREIGN PATENT DOCUMENTS

| | | |
|---|---|---|
| JP | 5-34818 | 2/1993 |
| JP | 11-27647 | 1/1999 |
| JP | 2002-359617 | 12/2002 |
| JP | 2004-241970 | 8/2004 |

* cited by examiner

*Primary Examiner*—Phung Nguyen
(74) *Attorney, Agent, or Firm*—Oblon, Spivak, McClelland, Maier & Neustadt, L.L.P.

(57) ABSTRACT

In a movie projection system, a switch circuit is disposed on a door of a case in which a video server is disposed. A tamper detector detects a state of the door as to whether the door is open or not and a state of the switch circuit as to whether the switch circuit has been tampered with or not, on the basis of an output signal provided by the switch circuit. A projecting operation controller controls the operation of the movie projection system such that when the door is detected to be in the open state or the switch circuit is detected to have been tampered with, the projecting operation controller stops inputting and outputting video data to or from the video server.

10 Claims, 7 Drawing Sheets

FIG. 5

| STATUS | N.C. | N.O. | TAMPER DETECTION | SIGNAL OUTPUT | RESULT |
|---|---|---|---|---|---|
| SWITCH: OPEN | H | - | H | L | TAMPERED |
| SWITCH: CLOSED | - | H | H | H | NORMAL |
| SWITCH UNIT: NOT CONNECTED | - | - | L | L | TAMPERED |
| SWITCH UNIT: ERROR | H(L) | H(L) | L | L | TAMPERED |

FIG. 7

| STATUS | N.C. | N.O. | AND #1 OUTPUT | AND #2 OUTPUT | TAMPER DETECTION | SIGNAL OUTPUT | RESULT |
|---|---|---|---|---|---|---|---|
| SWITCH: OPEN | H | - | L | H | H | L | TAMPERED |
| SWITCH: CLOSED | - | H | H | L | H | H | NORMAL |
| SWITCH UNIT: NOT CONNECTED | - | - | L | L | L | L | TAMPERED |
| SWITCH UNIT: ERROR | H(L) | H(L) | H(L) | H(L) | L | L | TAMPERED |

MOVIE PROJECTION SYSTEM

CROSS REFERENCES TO RELATED APPLICATIONS

The present invention contains subject matter related to Japanese Patent Application JP 2007-120953 filed in the Japanese Patent Office on May 1, 2007, the entire contents of which are incorporated herein by reference.

BACKGROUND OF THE INVENTION

1. Field of the Invention

The present invention relates to a movie projection system.

2. Description of the Related Art

In recent years, many video contents have been produced in a digital form, and it has become popular to use digital video data instead of analog films in screening movies in movie theaters or the like using movie projection systems. However, use of digital video data has a problem that digital video data can be easily copied or tampered with, and data acquired or copied in an authorized manner can be used to play back a movie or the like with high quality similar to that of the original data. Besides, recent widely-used broadband environments allow large-size data to be easily distributed, and, in fact, there is actually an environment that allows data to be distributed in an authorized manner using P2P (Peer to Peer) or similar techniques. If digital video data is stolen directly from a movie projection system, an incomparably great loss can occur.

However, currently available movie projection systems do not necessarily have high resistance to stealing of digital video data. A typical movie projection system includes, in a case, a storage device adapted to store digital video data and a video server adapted to read digital video data from the storage device and play back a content according to the digital video data. In many cases, to prevent digital video data from being easily read out in an unauthorized manner, the storage device and the video server have an encryption capability. However, even in such a movie projection system having an encryption capability, a transmission channel between the storage device and the video server does not necessarily have high resistance to tampering.

One technique for solving the above problem is to limit access to the inside of the case of the movie projection system. For example, a maintenance door of a case is configured to prevent an unauthorized opening, or the operation of the movie projection system is stopped when an unauthorized opening is detected. More specifically, a switch for detecting opening of a door is disposed on the door. If the door is opened in an authorized manner, the switch on the door turns on, and a signal may be supplied from the switch to notify a manager or an operator of the movie projection system of the occurrence of tampering.

Further related information may be found, for example, in Japanese Unexamined Patent Application Publication No. 5-34818.

SUMMARY OF THE INVENTION

In the technique described above, if the switch for detecting an unauthorized opening of the door is tampered with, the capability of detecting an unauthorized access to the inside of the case is lost. To enhance the security, a plurality of switches may be disposed on a door thereby to enhance the resistance to the tampering. However, even in this case, the above-described problem cannot be completely avoided. Besides, such a redundant configuration results in an increase in circuit complexity and an increase in cost.

In view of the above, it is desirable to provide a movie projection system capable of detecting an unauthorized access to the inside of a case of a movie projection system thereby to preventing video data from being stolen.

According to an embodiment of the present invention, there is provided a movie projection system including a switch circuit disposed on a door of a case in which a video server is disposed, a tamper detector adapted to detect a state of the door as to whether the door is open or not and a state of the switch circuit as to whether the switch circuit has been tampered with or not, on the basis of an output signal provided by the switch circuit, and a projecting operation controller adapted to control the operation of the movie projection system such that when the door is detected to be in the open state or the switch circuit is detected to have been tampered with, the projecting operation controller stops inputting and outputting video data to or from the video server.

The switch circuit is disposed on the door of the case in which the video server is disposed. The tamper detector detects the state of the door as to whether the door is open or not and the state of the switch circuit as to whether the switch circuit has been tampered with or not, on the basis of the output signal provided by the switch circuit. When the projecting operation controller detects that the door is in the open state or the switch circuit has been tampered with, the projecting operation controller stops inputting and outputting video data to or from the video server. Thus, it is possible to prevent the video data input or output to or from the video server from being stolen by accessing the inside of the case in which the movie projection system is installed in an unauthorized manner. Furthermore, it is also possible to prevent the video data from being stolen by tampering with the switch disposed on the door of the case.

When the door is detected to be in the open state or the switch circuit is detected to have been tampered with, the projecting operation controller may disable reading of the video data from a data storage unit in which the video data is stored. In this implementation, by stopping outputting of video data from the data storage unit, it is possible to stop flowing of video data in any part of the movie projection system, and thus high security can be achieved.

The switch circuit may include an SPDT switch adapted to switch between two signal paths in synchronization with opening of the door, and the tamper detector may detect the state of the door as to whether the door is open or not or the state of the switch circuit as to whether the switch circuit has been tampered with, on the basis of two output signals supplied from the switch circuit. In this implementation, it is possible to perform both detections, using a relatively simple circuit configuration, in terms of whether the door is in the open state and whether the switch circuit has been tampered with. Thus, it is possible to achieve a high-security movie projection system at low cost.

The switch circuit may include an exclusive OR circuit with two inputs respectively connected to the two signal paths, and an AND circuit with two inputs one of which is connected to one of the two signal path and the other is connected to an output of the exclusive OR circuit. In this implementation, it is possible to perform both detections, using a relatively simple circuit configuration, in terms of whether the door is in the open state and whether the switch circuit has been tampered with. Thus, it is possible to achieve a high-security movie projection system at low cost.

The tamper detector may detect the state of the door as to whether the door is open or not and the state of the switch circuit as to whether the switch circuit has been tampered with, on the basis of an output signal provided by the exclusive OR circuit disposed in the switch circuit and an output signal of the AND circuit disposed in the switch circuit. This configuration makes it possible to perform the detection as to the states of doors of the case and as to the state of switch circuit individually for the doors and the switch circuit on the basis of the signals output from the switch circuit, and thus it is possible to control the movie projection system properly depending on the detected states.

The tamper detector may perform the detection such that when the tamper detector detects that the output signal provided by the exclusive OR circuit disposed in the switch circuit or the output signal provided by the AND circuit disposed in the switch circuit has an abnormal value, the tamper detector determines that the door is in the open state or the switch circuit has been tampered with. In this implementation, the detection is performed in terms of whether the door is in the open state and whether the switch circuit has been tampered with, and the movie projection system is properly controlled according to the detection result.

The switch circuit may include a plurality of switch units respectively disposed on a plurality of doors disposed on the case, and an electric circuit unit connected to the plurality of switch units and adapted to detect states of the doors as to whether any of the doors is open or not and states of the switch units as to whether any of the switch units has been tampered with or not.

This configuration makes it possible to perform the detection as to whether any one of the doors of the case is in an unauthorized open state and as to whether any one of the plurality of switch units has been tampered with. Furthermore, it becomes possible to monitor the state of each of the plurality of doors by monitoring the outputs of the electric circuit unit in a centralized manner. Thus, the movie projection system can be realized in a simplified form. That is, even in a case where the movie projection system includes a large number of parts, it is possible to manage the states of a large number of doors disposed on cases and detect tampering, in a centralized manner using the control system (the projecting operation controller) configured in a simple form. Thus, it is possible to realize the high-security movie projection system with a simplified total configuration at low cost. It is also possible to monitor the state of the electric circuit unit in terms of tampering.

Each switch unit may include an SPDT switch adapted to switch between two signal paths, and a first output terminal and a second output terminal via which to electrically connect the two signal paths to the electric circuit unit. The electric circuit unit may include a plurality of first input terminals respectively connected to the first output terminals of the plurality of switch units, a plurality of second input terminals respectively connected to the second output terminals of the plurality of switch units, a first AND circuit with inputs respectively connected to the outputs of the plurality of first input terminals, a second AND circuit with inputs respectively connected to the outputs of the plurality of second input terminals, an exclusive OR circuit with inputs respectively connected to the output of the first AND circuit and the output of the second AND circuit, and a third AND circuit with inputs respectively connected to the output of the first AND circuit and the output of the exclusive OR circuit.

In this implementation, it is possible to perform the detection, using a relatively simple circuit configuration, as to whether the door is in the open state and as to whether the switch circuit has been tampered with. Thus, even in a case where the movie projection system includes a large number of parts, it is possible to achieve high capability of detecting tampering and thus achieve high security.

The tamper detector may detect the states of the doors as to whether any of the doors is open or not and states of the switch units as to whether any of the switch units has been tampered with or not, on the basis of the output signal provided by the exclusive OR circuit disposed in the switch circuit and the output signal provided by the third AND circuit disposed in the switch circuit. In this configuration, it is possible to perform the detection as to the states of doors of the case and as to the state of switch circuit individually for the doors and the switch circuit on the basis of the signals output from the switch circuit, and thus it is possible to control the movie projection system properly depending on the detected states.

The tamper detector may perform the detection such that when the tamper detector detects that the output signal provided by the exclusive OR circuit disposed in the switch circuit or the output signal provided by the third AND circuit disposed in the switch circuit has an abnormal value, the tamper detector determines that the door is in the open state or the switch circuit has been tampered with. In this implementation, if any door is detected to be in the open state or the switch circuit has been tampered with, the movie projection system is properly controlled according to the detection result.

That is, use of the switch circuit configured in the above-described manner makes it possible to detect the state of each door provided for use to access the inside of the case including therein a device in which confidential information is stored, and it is possible to perform the detection as to whether any door or the switch circuit has been tampered with.

As described above, the present invention provides the advantage that it is possible to detect an unauthorized access to the inside of the case in which the system is installed, and prevent the video data from being stolen.

BRIEF DESCRIPTION OF THE DRAWINGS

FIG. 5 is a diagram provided for an explanation of a method of detecting tampering according to an embodiment of the present invention;

FIG. 7 is a diagram provided for an explanation of a method of detecting tampering according to an embodiment of the present invention.

DESCRIPTION OF THE PREFERRED EMBODIMENTS

Figure 1:
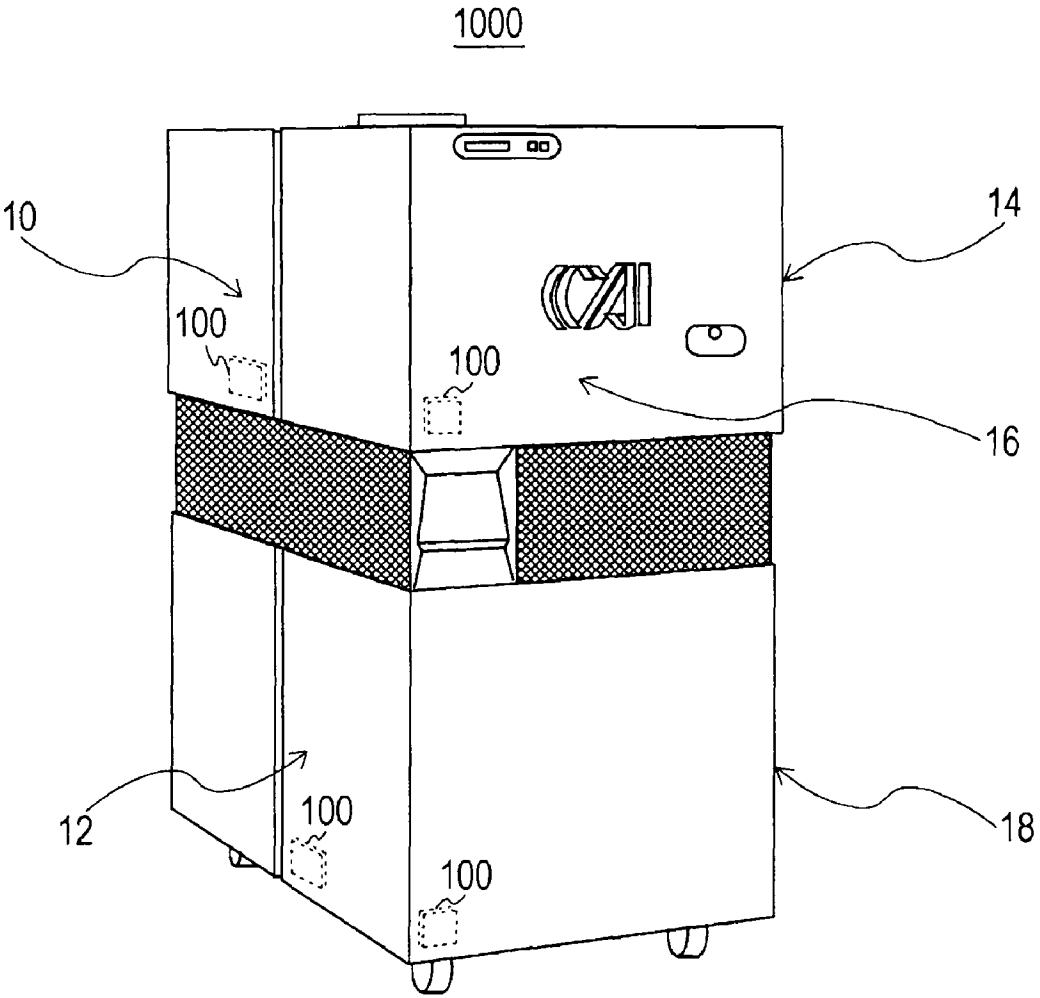
FIG. 1 is a schematic diagram illustrating a configuration, in particular in terms of doors, of a movie projection system according to an embodiment of the present invention.

The present invention is described in further detail below with reference to embodiments in conjunction with the accompanying drawings. In the present description and the accompanying drawings, parts substantially similar in function are denoted by similar reference numerals, and duplicated explanations thereof are omitted.

First Embodiment

First, a configuration of a movie projection system 1000 according to an embodiment of the present invention is described. The movie projection system 1000 according to the present embodiment includes a tamper detection switch circuit 100 disposed on each maintenance door, and a projection system controller 600 adapted to control the operation of the movie projection system 1000 in accordance with a tamper detection signal output from the switch circuit 100.

Configuration of Movie Projection System in Terms of Doors

Referring to FIG. 1, the configuration in terms of doors of the movie projection system 1000 according to the present embodiment is described below. FIG. 1 is a schematic diagram illustrating an external appearance of the movie projection system 1000 according to the present embodiment of the invention. Note that this external appearance is shown by way of example only, and the movie projection system 1000 may be configured in different appearances. Furthermore, there is no particular restriction on the number of doors, and the shapes, the locations, and the purpose thereof. The number of and/or the locations of switch circuits 100 disposed on each door may be arbitrarily determined depending on the configuration of the door.

As shown in FIG. 1, the movie projection system 1000 mainly includes an optical unit adjustment door 10, a controller adjustment door A12, a circuit unit adjustment door 14, a lamp exchange door 16, a controller adjustment door B18, and a switch circuit 100.

The optical unit adjustment door 10 is used to access the inside of the case of the movie projection system 1000 when an optical unit 24 (described later) is adjusted or repaired. The controller adjustment door A12 and the controller adjustment door B18 are used to access the inside of the case of the movie projection system 1000 when the projection system controller 600 is adjusted or repaired. The circuit unit adjustment door 14 is used to access the inside of the case of the movie projection system 1000 when a circuit unit 26 (described later) is adjusted or repaired. The lamp exchange door 16 is used to access the inside of the case of the movie projection system 1000 when a lamp 22 (described later) is exchanged.

Each door has a switch circuit 100 for detecting tampering. As will be described in further detail later, each switch circuit 100 turns on/off in response to opening/closing of the door on which the switch circuit 100 is disposed. If any door is opened in an unauthorized manner, the opening is detected by the switch circuit 100 disposed on the door, and a tamper detection signal is supplied to the projection system controller 600. The locations of the respective switch circuits 100 are not limited to those shown in FIG. 1, but switch circuits 100 may be disposed at other locations as long as the switch circuits 100 turn on/off in response to opening/closing of the corresponding doors.

Configuration of Movie Projection System

Figure 2:
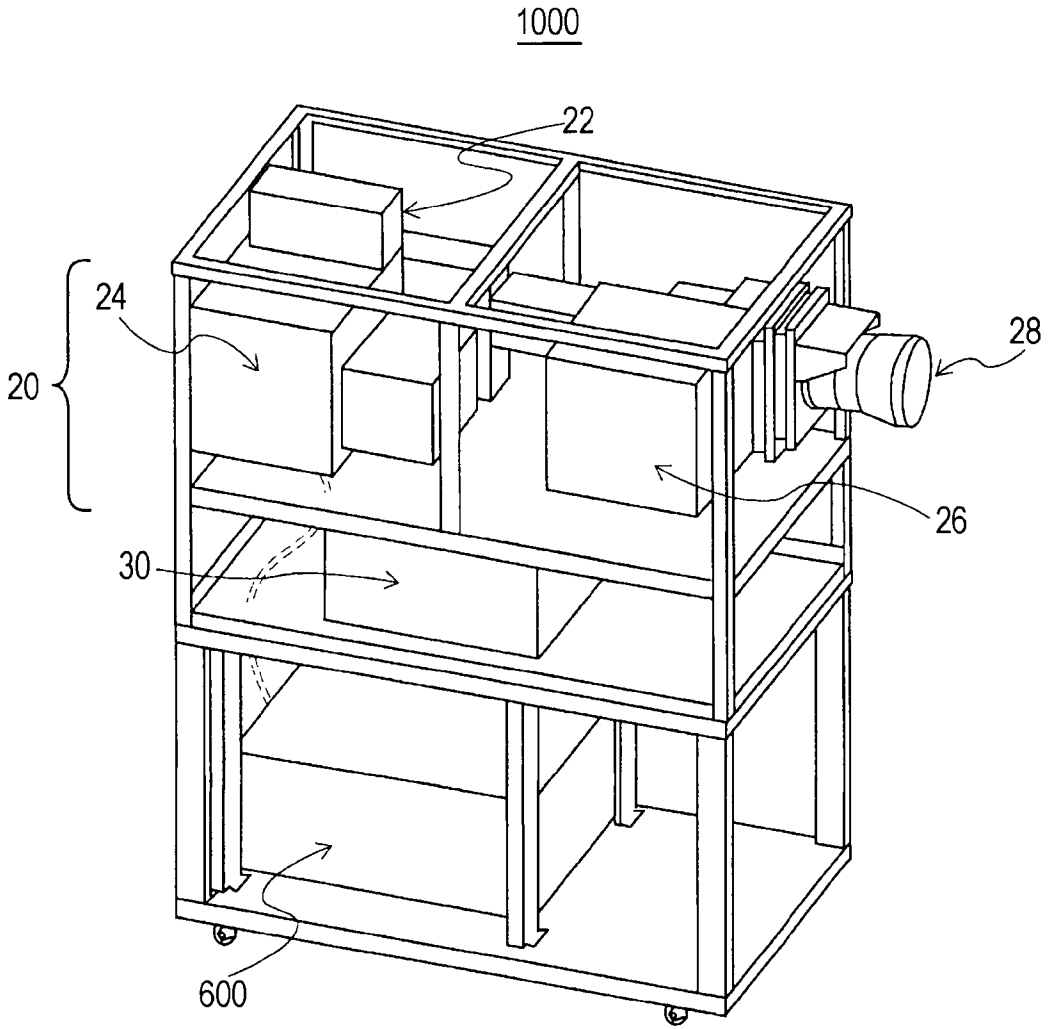
FIG. 2 is a diagram illustrating an internal configuration of a movie projection system according to an embodiment of the present invention.

Next, referring to FIG. 2, the configuration of the movie projection system 1000 according to the present embodiment of the invention is described below. FIG. 2 illustrates an example of a configuration of the movie projection system 1000 according to the present embodiment of the invention. Note that in FIG. 2, for ease of understanding, the locations of respective parts are shown in a schematic manner, and various modifications are allowed depending on the actual use. However, it is important that the doors shown in FIG. 1 are disposed at particular locations relative to the locations of the parts shown in FIG. 2. That is, the doors should be located such that the parts of the movie projection system 1000 and data communication channels among the parts can be accessed via the door from the outside of the case.

Although not all but only some data communication channels among the parts are shown in FIG. 2, the movie projection system 1000 actually includes all necessary data communication channels. If there is no protection, there is a possibility that input/output signals to/from the parts at locations corresponding to the respective doors are stolen via the doors. Thus, the switch circuit 100 disposed on each door monitors opening/closing of the door. If any door is opened, the switch circuit 100 detects the opening of the door, and video data is prevented from being stolen via the input/output signal to/from the parts.

As shown in FIG. 2, the movie projection system 1000 includes, mainly, a lamp 22, an optical unit 24, a circuit unit 26, a lens 28, a power supply unit 30, and a projection system controller 600. The lamp 22, the optical unit 24, the circuit unit 26, and the lens 28 form a projector 20 for optically projecting a video signal.

Projector

As for the projector 20, for example, an LCOS (Liquid Crystal On Silicon) projector such as an SXRD (Silicon X-tal Reflective Display), a GLV (Grating Light Valve) projector, a liquid crystal projector, or a CRT projector may be used. In the following explanation, by way of example, it is assumed that a liquid crystal projector is used.

The lamp 22 is a light source using, for example, a discharge lamp. The optical unit 24 may include, for example, a liquid crystal panel adapted to transmit light emitted from the lamp 22 so as to form an image, and an optical system adapted to focus the transmitted light on the lens 28. The circuit unit 26 serves to control the liquid crystal panel of the optical unit 24 in accordance with the video signal output from the projection system controller 600. The circuit unit 26 also serves to make an adjustment in terms of zooming and focusing of the lens 28.

Power Supply

The power supply unit 30 serves to provide electric power mainly to the projector 20 and the projection system controller 600. The power supply unit 30 may also supply electric power to the switch circuits 100 disposed on the respective doors of the movie projection system 1000. Electric power may be supplied directly to each part from the power supply unit 30 or indirectly via some other parts.

Projection System Controller

The projection system controller 600 decodes video data into a video signal and supplies the resultant video signal to the projector 20, and the projection system controller 600 controls the projector 20 to project an image in accordance with the video signal. The projection system controller 600 acquires the tamper detection signal from the switch circuits 100 disposed on the each door of the case of the movie projection system 1000, and the projection system controller 600 determines whether an unauthorized access to the inside of the case via the door has occurred. Furthermore, the projection system controller 600 may control the projecting operation of the projector 20 depending on the tamper detection signal indicating an occurrence/absence of an unauthorized access. More specifically, if the projection system controller 600 receives, from the switch circuit 100, the tamper detection signal from the switch circuit 100 indicating that any one or more of the doors disposed on the case have been opened in an unauthorized manner, the projection system controller 600 controls the projector 20 to stop outputting the video signal.

The configuration of the movie projection system 1000 according to the present embodiment of the invention has been described briefly. As described above, in the present embodiment, the movie projection system 1000 includes tamper detection switch circuits 100 disposed on the respective doors of the case whereby if the tamper detection signal indicating the occurrence of tampering is output from the switch circuit 100, the projection system controller 600 disables outputting of the video signal thereby preventing the video signal and the video data from being transmitted in any part in the movie projection system 1000.

Thus, it is possible to prevent an unauthorized access to the inside of the case via any of the doors provided for authorized use for check, adjustment, repair, or exchange of a part, thereby preventing the video signal or the video data from being stolen. The movie projection system 1000 includes many parts which need to be checked in terms of loosening of screws or the like, fitting between parts, connection between connectors, etc., and thus the movie projection system 1000 includes many doors used to directly access such parts for such purposes. Thus the tamper detection/prevention mechanism according to the present embodiment described above is useful to achieve high security.

Functional Configuration of Projection System Controller

Figure 3:
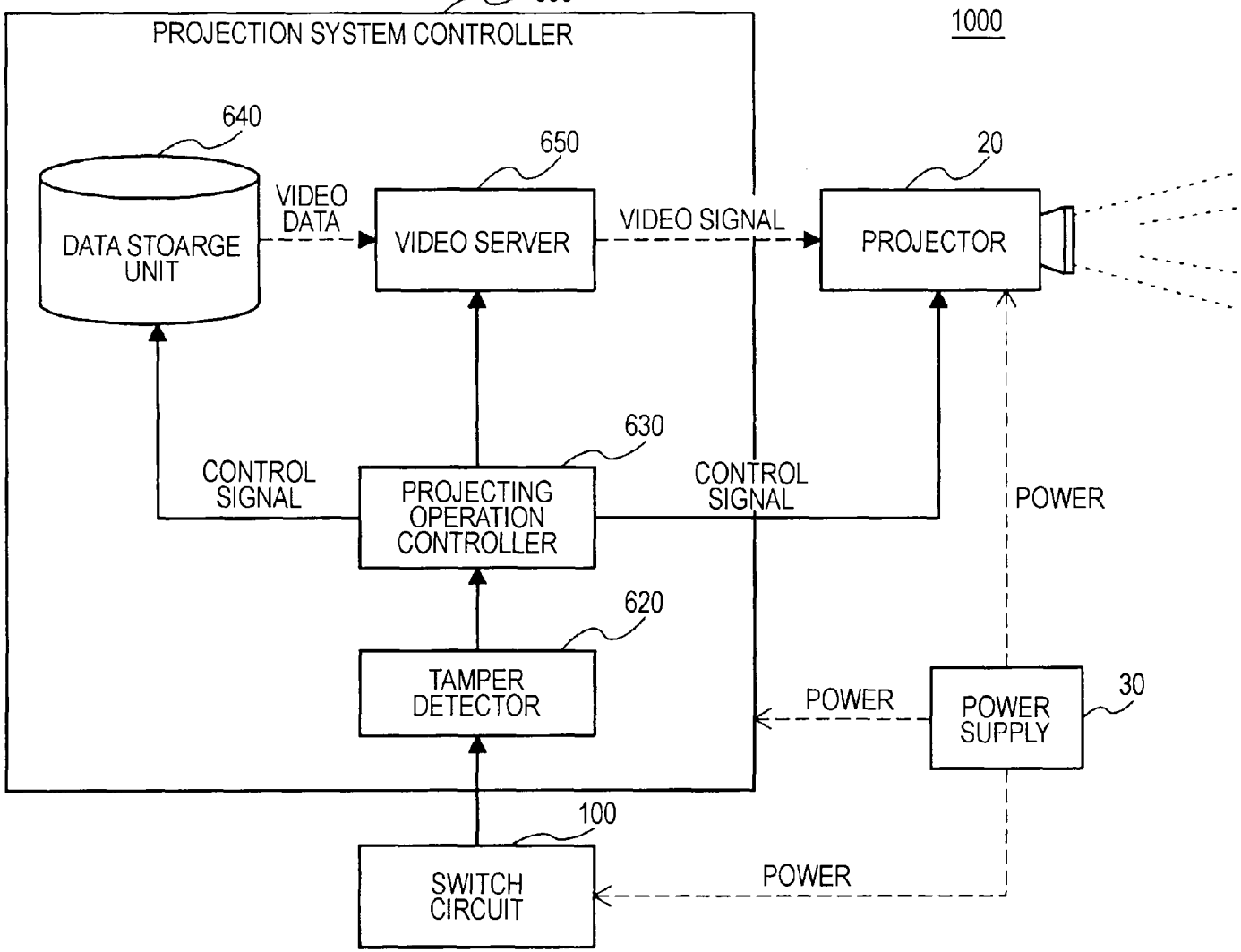
FIG. 3 is a block diagram illustrating a functional configuration of a movie projection system according to an embodiment of the present invention.

Next, referring to FIG. 3, the functional configuration of the projection system controller 600 according to the present embodiment of the invention is described. FIG. 3 illustrates the functional configuration of the projection system controller 600 according to the present embodiment of the invention.

As shown in FIG. 3, the projection system controller 600 mainly includes a tamper detector 620, a projecting operation controller 630, a data storage unit 640, and a video server 650.

Tamper Detector

The tamper detector 620 determines whether any door is in an open state and whether any switch circuit 100 has been tampered with, on the basis of output signals provided from the switch circuits 100 disposed on the respective doors of the movie projection system 1000. If the tamper detector 620 determines that some door is in an unauthorized open state or some switch circuit 100 has been tampered with, the tamper detector 620 outputs a tamper detection signal to notify the projecting operation controller 630 of the occurrence of tampering.

In the case where a plurality of switch circuits 100 are disposed on a plurality of doors, the tamper detector 620 acquires output signals from the respective switch circuits 100 and examines the acquired output signals to determine whether any door is in an unauthorized open state and whether any switch circuit 100 has been tampered with. If the tamper detector 620 receives, from one of the switch circuits 100, an output signal indicating that one of the doors is in an unauthorized open state or one of the switch circuits 100 has been tampered with, then the tamper detector 620 transmits a tamper detection signal to the projecting operation controller 630.

Projecting Operation Controller

The projecting operation controller 630 transmits a control signal to the data storage unit 640, the video server 650, and the projector 20 to control them such that a specified movie image is projected. In the case where the projecting operation controller 630 receives a tamper detection signal from the tamper detector 620, the projecting operation controller 630 transmits a control signal to the data storage unit 640, the video server 650, and the projector 20 to disable the operation of outputting or transmitting video data from the data storage unit 640 to the video server 650 and disable the operation of outputting or transmitting the video signal from the video server 650 to the projector 20.

Data Storage Unit

The data storage unit 640 is a storage device for storing the video data. As for the data storage unit 640, for example, a magnetic storage device such as a hard disk drive, an optical/electro-optical storage device such as a CD (Compact Disc), DVD (Digital Versatile Disc), or BD (Blu-ray Disc), or a semiconductor storage device may be used. Alternatively, the data storage unit 640 may be implemented in the form of an external storage device connected to the projection system controller 600, such as a NAS (Network Attached Storage) device having a redundant configuration based on the PAID (Redundant Arrays of Inexpensive Disks) scheme or the like. The data storage unit 640 may have a function of restricting an access request for the stored video data from the outside, and may have a function of storing the video data in an encrypted form. The data storage unit 640 may also have a function of sending no video data to the video server 650 when instructed to do so by a control signal received from the projecting operation controller 630.

Video Server

In accordance with a control signal received from the projecting operation controller 630, the video server 650 decodes video data of a specified movie read from the data storage unit 640 into a video signal and transmits the resultant video signal to the projector 20. The projector 20 projects a movie image in accordance with the supplied video signal. In a case where the video server 650 receives from the projecting operation controller 630 a control signal commanding that the transmission of the video data and the video signal should be stopped, the video server 650 stops reading the video data from the data storage unit 640 and stops outputting the video signal to the projector 20.

In the present embodiment, as described above, if the tamper detector 620 detects an occurrence of tampering on the basis of the output signal from the switch circuit 100 disposed on the case, the projection system controller 600 controls the projecting operation controller 630 to stop transmission or flowing of the video data and the video signal among the data storage unit 640, the video server 650, and the projector 20. Thus, when the inside of the case is accessed, no video data and no video signal are transmitted in the projection system controller 600, and thus any video data and any video signal are not stolen. Thus, the movie projection system 1000 configured in the above-described manner has greatly improved security.

Configuration of Switch Circuit

Figure 4:
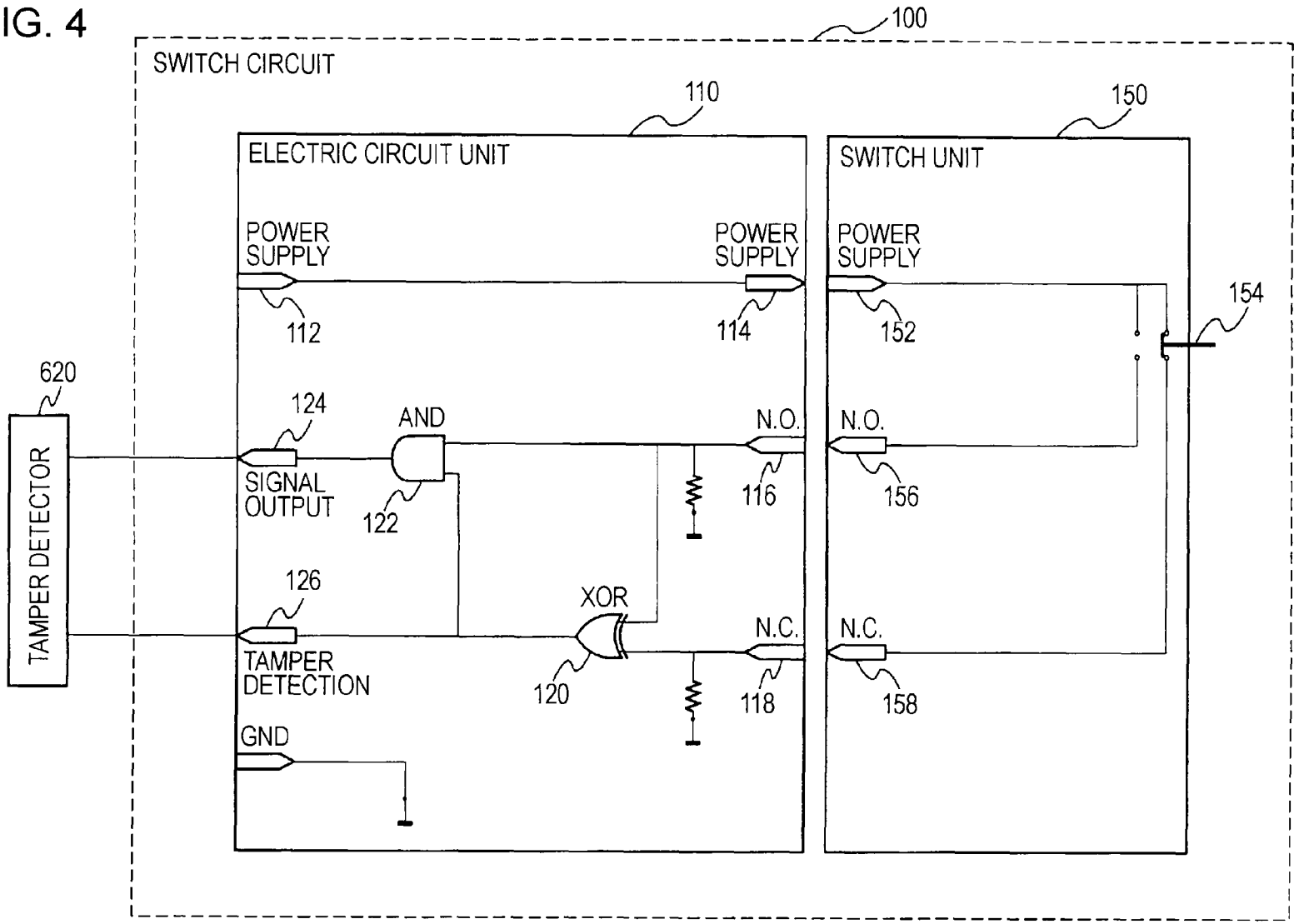
FIG. 4 is a diagram illustrating a switch circuit according to an embodiment of the present invention.

Next, referring to FIG. 4, the circuit configuration of the switch circuit 100 according to the present embodiment of the invention is described below. FIG. 4 illustrating the circuit configuration of the switch circuit according to the present embodiment. As described above, the switch circuit 100 has the function of detecting opening of a case door and tampering with the switch circuit 100 itself. To achieve this detection function, the switch circuit 100 is configured, for example, as follows.

As described above, in the case of the switch circuit based on the SPST (Single Pole Single Throw) structure and having the simply function of detecting only opening of a case door, the connection of the switch circuit can be easily changed such that the switch circuit no longer has the capability of detecting tampering. If a plurality of switch circuits are disposed, the resistance to tampering can be enhanced. However, even in this case, if all switch circuits are tampered with, the capability of detecting tampering is lost. Besides, redundant use of a plurality of switch circuits results in an increase in cost. In contrast, in the present embodiment, the switch circuit 100 uses an SPDT (Single Pole Double Throw) switch and has a circuit configuration capable of detecting tampering with the switch circuit 100 itself. Thus, the switch circuit according to the present embodiment has high performance and high reliability, and can be realized at low cost.

Specific Circuit Configuration

As shown in FIG. 4, the switch circuit 100 includes an electric circuit unit 110 and a switch unit 150. The electric circuit unit 110 is configured to output two output signals to the tamper detector 620.

The electric circuit unit 110 includes a power supply input terminal 112, a power supply output terminal 114, an NO (normally open) input terminal 116, an NC (normally closed) input terminal 118, a XOR (exclusive OR) circuit 120, an AND circuit 122, a first output terminal (signal output)124, and a second output terminal (tamper detection) 126. These elements are formed on a circuit board with a ground line.

The switch unit 150 includes a power supply input terminal 152, an SPDT switch 154, an NO (normally open) output terminal 156, and an NC (normally closed) output terminal 158. The SPDT switch 154 switches a signal path such that a signal input from the power supply input terminal 152 is transferred to either the NO output terminal 156 or the NC output terminal 158. That is, the signal input from the power supply input terminal 152 is transferred to the NO output terminal 156 or the NC output terminal 158 depending on whether the SPDT switch 154 is in an on or off state.

The switch circuit 100 configured in the above-described manner has the capability of detecting tampering as described below. The electric circuit unit 110 and the switch unit 150 are connected to each other in terms of signal path between the power supply output terminal 114 and the power supply input terminal 152, between the NO input terminal 116 and the NO output terminal 156, and between NC input terminal 118 and the NC output terminal 158.

If a voltage signal is applied to the power supply input terminal 112, the signal is transmitted to the SPDT switch 154 via the power supply output terminal 114 and the power supply input terminal 152, and is transferred therefrom to the NO output terminal 156 or NC output terminal 158. More specifically, when the door on which the switch circuit 100 is disposed is in the open state, the SPDT switch 154 is switched in a position that causes the signal to be transferred to the NC output terminal 158. On the other hand, when the door on which the switch circuit 100 is disposed is in the closed state, the SPDT switch 154 is switched in a position that causes the signal to be transferred to the NO output terminal 156. Thus, the switching of the SPDT switch 154 makes it possible to detect whether the door on which the SPDT switch 154 is disposed is in the open state or the closed state.

Open State

When the door is in the open state, the switch circuit 100 operates as follows. As described above, when the door is in the open state, the SPDT switch 154 connects the signal path to the NC output terminal 158, and thus the signal is output to the NC output terminal 158. As a result, the signal is transferred from the NC output terminal 158 to the NC input terminal 118 connected to the NC output terminal 158. Hereinafter, this state in which the signal is input to the NC input terminal 118 and thus the NC input terminal 118 is at a high voltage level (H-level) will be referred to as a normal state. By pulling down the NO input terminal 116 and the NC input terminal 118 as shown in FIG. 4, it is also possible to detect a state in which no signal is supplied to the NO input terminal 116 or the NC input terminal 118 and thus the NO input terminal 116 or the NC input terminal 118 is at a pulled-down low voltage level (L-level). The H-level and L-level correspond to a logical "1" level and "0" level, respectively.

The signal supplied to the NC input terminal 118 is applied to the XOR circuit 120. The signal supplied to the NO input terminal 116 is divided into two signal paths one of which is connected to an input of the XOR circuit 120 and the other is connected to an input of the AND circuit 122. As a result of the exclusive OR operation performed by the XOR circuit 120, the output of the XOR circuit 120 becomes high (H) when either one of the two inputs is high (H) and the other is low (L), while in any other case, the output of the XOR circuit 120 becomes low (L).

As described above, when the SPDT switch 154 is in the open state, the NO input terminal 116 is at the L level and the NC input terminal 118 is at the H level. Thus, the output of the XOR circuit 120 becomes high (H). The signal output from the XOR circuit 120 is divided into two signal paths one of which is connected to an input of the AND circuit 122 and the other is connected to the second output terminal 126.

The AND circuit 122 is supplied with the signal from the NO input terminal 116 and the signal output from the XOR circuit 120. As a result of the logical AND operation performed by the AND circuit 122, the output of the AND circuit 122 becomes high (H) when both inputs are high, while the output becomes low (L) in any other case. Thus, when the SPDT switch 154 is in the open state, the NO output terminal 156 is at the low level (L) and the signal supplied from the XOR circuit 120 is high (H). Thus, the output of the AND circuit 122 becomes low (L). As a result, an L-level signal is supplied to the first output terminal 124.

As described above, the switch circuit 100 according to the present embodiment operates such that when the SPDT switch 154 is in the open state, the L-level signal is output from the first output terminal 124 and the H-level signal is output from the second output terminal 126. In this state, if the power supply input terminal 152 and the NO output terminal 156 are illegally connected to each other, the NO input terminal 116 becomes high (H) and the output of the XOR circuit 120 becomes low (L). As a result, the output of the AND circuit 122 becomes low (L). Thus, the level of the first output terminal 124 becomes low (L) and the level of the second output terminal 126 becomes low (L), and thus the tamper detector 620 detects the occurrence of tampering.

Closed State

When the door is in the closed state, the switch circuit 100 operates as follows. As described above, when the door is in the closed state, the SPDT switch 154 connects the signal path to the NO output terminal 156, and thus the H-level signal is output to the NO output terminal 156. As a result, the H-level signal is transferred from the NO output terminal 156 to the NO input terminal 116 connected to the NO output terminal 156. On the other hand, the L-level signal is transferred from the NC output terminal 158 to the NC input terminal 118 connected to the NC output terminal 158.

Thus, when the SPDT switch 154 is in the closed state, the NO output terminal 156 is at the high level (H) and the NC output terminal 158 is at the low level (L). Thus, the output of the XOR circuit 120 becomes high (H). The H-level signal output from the XOR circuit 120 is divided into two signal paths one of which is connected to one of the inputs of the AND circuit 122 and the other is connected to the second output terminal 126.

The AND circuit 122 is supplied with the H-level signal from the NO input terminal 116 and the H-level signal output from the XOR circuit 120. In this case, as a result of the logical AND operation performed by the AND circuit 122, the output of the AND circuit 122 becomes high (H). As a result, the H-level signal is supplied to the first output terminal 124.

As described above, the switch circuit 100 according to the present embodiment operates such that when the SPDT switch 154 is in the closed state, the H-level signal is output from the first output terminal 124 and the H-level signal is output from the second output terminal 126. In a state in which the electric circuit unit 110 and the switch unit 150 are not connected to each other, both the NO input terminal 116 and the NC output terminal 158 becomes low (L), and thus, the level of the first output terminal 124 becomes low (L) and the level of the second output terminal 126 becomes low (L).

Detection of Tampering

The detection of tampering is described in further detail below with reference to FIG. 5. FIG. 5 is a diagram provided for an explanation of a method of detecting tampering according to the present embodiment of the invention.

In the circuit configuration described above, it is possible to determine whether tampering occurs by checking the output of the first output terminal 124 and the output of the second output terminal 126. In FIG. 5, the detection result in terms of the occurrence/absence of tampering is shown in the form of a table for various combinations of states/levels of the SPDT switch 154, the NC output terminal 158, the NO output terminal 156, the first output terminal 124 (signal output), and the second output terminal 126 (tamper detection).

As shown in FIG. 5, when the SPDT switch 154 is in the open state, an H-level signal is output from the NC output terminal 158, while no signal is output from the NO output terminal 156. In this case, an H-level signal is output from the second output terminal 126 (tamper detection) while an L-level signal is output from the first output terminal 124 (signal output). As a result, the tamper detector 620 determines that the door is in the open state or the switch circuit 100 has been tampered with. Note that in the table shown in FIG. 5, "tampered" generically denotes abnormal states including the state in which the door is in the open state.

On the other hand, when the SPDT switch 154 is in the closed state, no signal is output from the NC output terminal 158, while an H-level signal is output from the NO output terminal 156. In this case, the signal level becomes high (H) both at the second output terminal 126 (tamper detection) and the first output terminal 124 (signal output). Thus, the tamper detector 620 determines that the door is not in the open state and the switch circuit 100 is in the normal state subjected to no tampering.

In the case where the electric circuit unit 110 is not connected to the switch unit 150, no signal is output from the NC output terminal 158 and the NO output terminal 156. As a result, both the first output terminal 124 and the second output terminal 126 output an L-level signal. In this case, the tamper detector 620 determines that the door is in the open state or the switch circuit 100 has been tampered with. Note that when the SPDT switch 154 does not connect the signal path to either the NO output terminal 156 or the NC output terminal 158, this state can be regarded as being equivalent to the state in which the electric circuit unit 110 is not connected to the switch unit 150. Furthermore, a state in which the interconnection from the power supply input terminal 152 is disconnected is also equivalent to the state in which the electric circuit unit 110 is not connected to the switch unit 150.

When the switch unit 150 is in an abnormal state in which an H-level (or L-level) signal is output from both the NO output terminal 156 and the NC output terminal 158, an L-level signal is output from both the second output terminal 126 (tamper detection) and the first output terminal 124 (signal output). In this case, the tamper detector 620 determines that the door is in the open state or the switch circuit 100 has been tampered with.

As described above, the switch circuit 100 according to the present embodiment is capable of detecting the state of the door as to whether the door is open or not and the state of the switch circuit 100 as to whether the switch circuit 100 has been subjected to a disconnection, an additional connection, or any other tampering. Furthermore, when the switch circuit 100 itself is in a failed state, the tamper detector 620 determines that tampering has occurred. The SPDT switch 154 is used so that exclusive outputs are provide at the two output terminals thereof in the normal state, whereby the switch circuit 100 having high performance in detecting various abnormal modes including tampering, failure, disconnection, incorrect connection, etc., in the switch circuit 100 can be achieved using a simple combination of logic circuits (the XOR circuit 120, the AND circuit 122, etc.)

Modifications

Figure 6:
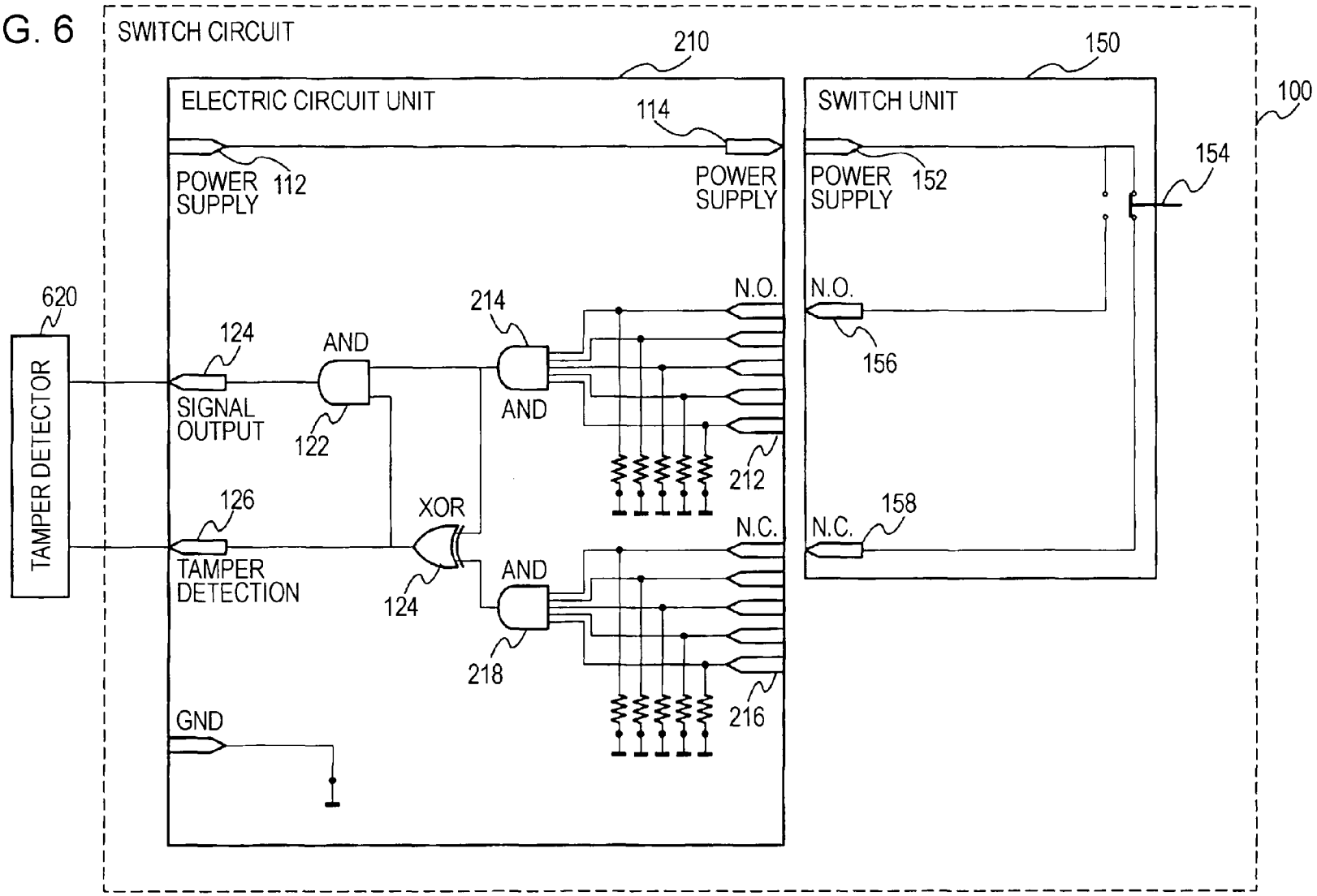
FIG. 6 is a diagram illustrating a switch circuit according to an embodiment of the present invention.

A modification to the above-described embodiment of the switch circuit 100 is described below with reference to FIG. 6. FIG. 6 illustrates a circuit configuration of the switch circuit 100 according to a modified embodiment of the invention. In this modified embodiment, the switch circuit 100 includes a plurality of switch units 150 and an electric circuit unit 210 connected to the plurality of switch units 150. In FIG. 6 and in the following explanation, similar parts to those in the electric circuit unit 110 described above with reference to FIG. 4 are denoted by similar reference numerals, and a further explanation thereof is omitted.

Electric Circuit Unit

As shown in FIG. 6, the electric circuit unit 210 includes a power supply input terminal 112, a power supply output terminal 114, a plurality of NO input terminals 212, AND circuits 122, 214, and 218, a plurality of NC input terminals 216, a XOR circuit 120, a first output terminal 124, and a second output terminal 126.

The electric circuit unit 210 is characterized by the circuit configuration using the plurality of NO input terminals 212, the plurality of NC input terminals 216, the AND circuit 214 with inputs connected to all respective NO input terminals 212, and the AND circuit 218 having inputs each of which is connected to one of NC input terminals 216 such that all NC input terminals 216 are connected to the AND circuit 218. In the following explanation, it is assumed that each of all NO input terminals 212 and each of all NC input terminals 216 of the electric circuit unit 210 are connected to corresponding one of a plurality of switch units 150. Note that in a case where some NO input terminal 212 and NC input terminal 216 are not used, a dummy circuit may be used to unused terminals.

All Closed State

In a case where doors are all in the closed state, an L-level signal is input to all NC input terminals 216 of the electric circuit unit 210, and an H-level signal is input to all NO input terminals 212. In this case, because all inputs of the AND circuit 218 are supplied with the L-level signals from the respective NC input terminals 216, the output of the AND circuit 218 becomes low (L). On the other hand, the inputs of the AND circuit 214 are supplied with the H-level signals from the respective NO input terminals 212, and thus the output of the AND circuit 214 becomes high (H). The H-level signal output from the AND circuit 214 is divided into two signal paths one of which is connected to an input of the XOR circuit 120 and the other is connected to an input of the AND circuit 122.

In the XOR circuit 120, the H-level input signal from the AND circuit 214 and the L-level input signal from the AND circuit 218 cause the XOR circuit 120 to become high in output. In the AND circuit 122, the H-level input signal from the AND circuit 214 and the H-level input signal from the XOR circuit 120 cause the AND circuit 122 to become high in output. As a result, both the first output terminal 124 and the second output terminal 126 output an H-level signal. On the basis of these output signals, the tamper detector 620 determines that the switch circuit 100 is in the normal state.

Partially Open State

When any one or more doors are in the open state, an H-level signal is input to corresponding one or more NC input terminals 216 of the electric circuit unit 210, and an L-level signal is input to the other NC input terminals 216. Similarly, an L-level signal is input to corresponding one or more NO input terminals 212, and an H-level signal is input to the other NO input terminals 212. As a result, both the AND circuit 218 and the AND circuit 214 output an L-level signal. Thus, the signals supplied to the two inputs of the XOR circuit 120 are both low (L), and thus an L-level signal is output to the second output terminal 126. On the other hand, the two input of the AND circuit 122 are both supplied with a low-level signal, and thus an L-level signal is output to the first output terminal 124.

Detection of Tampering

In addition to the situations described above, other various situations can also occur. In FIG. 7, the detection result in terms of the occurrence/absence of tampering is shown in the form of a table for various combinations of states/levels associated with the SPDT switch 154, the connection between the electric circuit unit 210 and the switch unit 150, and the switch unit 150. Note that in the table, AND #1 denotes the AND circuit 218, and AND #2 denotes the AND circuit 214. Referring to this table shown in FIG. 7, the detection of tampering is further explained below.

As shown in the table of FIG. 7, when all SPDT switches 154 of the switch units 150 connected to the electric circuit unit 210 are in the open state, the tamper detector 620 determines that all doors are in the open state or the switch circuit 100 has been tampered with. On the other hand, when all SPDT switches 154 of the switch units 150 connected to the electric circuit unit 210 are in the closed state, the tamper detector 620 determines that the system is in the normal state. In the case where the electric circuit unit 210 is not connected to the switch unit 150, the tamper detector 620 determines that some one or more doors are in the open state or the switch circuit 100 has been tampered with. If the switch unit 150 is in an abnormal state, the tamper detector 620 determines that some one or more doors are in the open state or the switch circuit 100 has been tampered with.

An example of a modification of the switch circuit 100 has been described above. As described above, by configuring an electric circuit unit (as with the electric circuit unit 210) so as to have a plurality of NO input terminals 212 and a plurality of NC input terminals 216 and so as to have the AND circuit 214 and the AND circuit 218 disposed between the XOR circuit 120 and the AND circuit 122 whereby the plurality of NO input terminals 212 are all input to the AND circuit 214 and the plurality of NC input terminals 216 are all input to the AND circuit 218, it becomes possible to monitor the states of the respective doors via the plurality of switch units 150. This modification does not need to change the interface of the switch unit 150, and thus it is allowed to directly use the original device to which the switch unit 150 is connected.

The present invention has been described above with reference to specific embodiments by way of example and not limitation. It should be understood by those skilled in the art that various modifications, combinations, sub-combinations and alterations may occur depending on design requirements and other factors insofar as they are within the scope of the appended claims or the equivalents thereof.

What is claimed is:

1. A movie projection system comprising:

a switch circuit disposed on a door of a case in which a video server is disposed;

a tamper detector adapted to detect both a state of the door as to whether the door is open or not and a state of the switch circuit as to whether the switch circuit has been tampered with or not, on the basis of an output signal provided by the switch circuit, said state of the door being different than said state of the switch circuit; and a projecting operation controller adapted to control the operation of the movie projection system based on both the state of the door and the state of the switch circuit such that when the door is detected to be in the open state or the switch circuit is detected to have been tampered with, the projecting operation controller stops inputting and outputting video data to or from the video server.

2. The movie projection system according to claim 1, wherein when the door is detected to be in the open state or the switch circuit is detected to have been tampered with, the projecting operation controller disables reading of the video data from a data storage unit in which the video data is stored.

3. The movie projection system according to claim 1, wherein the switch circuit includes an SPDT switch adapted to switch between two signal paths in synchronization with opening of the door; and the tamper detector detects the state of the door as to whether the door is open or not or the state of the switch circuit as to whether the switch circuit has been tampered with, on the basis of two output signals supplied from the switch circuit.

4. The movie projection system according to claim 1, wherein the switch circuit includes a plurality of switch units respectively disposed on a plurality of doors disposed in the case, and an electric circuit unit connected to the plurality of switch units and adapted to detect states of the doors as to whether any of the doors is open or not and states of the switch units as to whether any of the switch units has been tampered with or not.

5. A movie projection system comprising:

a switch circuit disposed on a door of a case in which a video server is disposed;

a tamper detector adapted to detect both a state of the door as to whether the door is open or not and a state of the switch circuit as to whether the switch circuit has been tampered with or not, on the basis of an output signal provided by the switch circuit, said state of the door being different than said state of the switch circuit; and a projecting operation controller adapted to control the operation of the movie projection system based on both the state of the door and the state of the switch circuit such that when the door is detected to be in the open state or the switch circuit is detected to have been tampered with, the projecting operation controller stops inputting and outputting video data to or from the video server, wherein when the door is detected to be in the open state or the switch circuit is detected to have been tampered with, the projecting operation controller disables reading of the video data from a data storage unit in which the video data is stored, the switch circuit includes an SPDT switch adapted to switch between two signal paths in synchronization with opening of the door; and the tamper detector detects the state of the door as to whether the door is open or not or the state of the switch circuit as to whether the switch circuit has been tampered with, on the basis of two output signals supplied from the switch circuit, wherein the switch circuit includes an exclusive OR circuit with two inputs respectively connected to the two signal paths, and an AND circuit with two inputs one of which is connected to one of the two signal path and the other is connected to an output of the exclusive OR circuit.

6. The movie projection system according to claim 5, wherein the tamper detector detects the state of the door as to whether the door is open or not and the state of the switch circuit as to whether the switch circuit has been tampered with, on the basis of an output signal provided by the exclusive OR circuit disposed in the switch circuit and an output signal of the AND circuit disposed in the switch circuit.

7. The movie projection system according to claim 6, wherein when the tamper detector detects that the output signal provided by the exclusive OR circuit disposed in the switch circuit or the output signal provided by the AND circuit disposed in the switch circuit has an abnormal value, the tamper detector determines that the door is in the open state or the switch circuit has been tampered with.

8. A movie projection system comprising:

a switch circuit disposed on a door of a case in which a video server is disposed;

a tamper detector adapted to detect both a state of the door as to whether the door is open or not and a state of the switch circuit as to whether the switch circuit has been tampered with or not, on the basis of an output signal provided by the switch circuit, said state of the door being different than said state of the switch circuit; and a projecting operation controller adapted to control the operation of the movie projection system based on both the state of the door and the state of the switch circuit such that when the door is detected to be in the open state or the switch circuit is detected to have been tampered with, the projecting operation controller stops inputting and outputting video data to or from the video server wherein the switch circuit includes a plurality of switch units respectively disposed on a plurality of doors disposed in the case, and an electric circuit unit connected to the plurality of switch units and adapted to detect states of the doors as to whether any of the doors is open or not and states of the switch units as to whether any of the switch units has been tampered with or not, wherein each switch unit includes a SPDT switch adapted to switch between two signal paths, and a first output terminal and a second output terminal via which to electrically connect the two signal paths to the electric circuit unit, and the electric circuit unit includes a plurality of first input terminals respectively connected to the first output terminals of the plurality of switch units, a plurality of second input terminals respectively connected to the second output terminals of the plurality of switch units, a first AND circuit with inputs respectively connected to the outputs of the plurality of first input terminals, a second AND circuit with inputs respectively connected to the outputs of the plurality of second input terminals, an exclusive OR circuit with inputs respectively connected to the output of the first AND circuit and the output of the second AND circuit, and a third AND circuit with inputs respectively connected to the output of the first AND circuit and the output of the exclusive OR circuit.

9. The movie projection system according to claim 8, wherein the tamper detector detects the states of the doors as to whether any of the doors is open or not and states of the switch units as to whether any of the switch units has been tampered with or not, on the basis of the output signal provided by the exclusive OR circuit disposed in the switch circuit and the output signal provided by the third AND circuit disposed in the switch circuit.

10. The movie projection system according to claim 9, wherein when the tamper detector detects that the output signal provided by the exclusive OR circuit disposed in the switch circuit or the output signal provided by the third AND circuit disposed in the switch circuit has an abnormal value, the tamper detector determines that one or more of the doors are in the open state or one or more of the switch circuits have been tampered with.

* * * * *